US012352514B2

(12) United States Patent
Liao

(10) Patent No.: US 12,352,514 B2
(45) Date of Patent: Jul. 8, 2025

(54) FOLDING STRUCTURE OF TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 203 days.

(21) Appl. No.: 18/454,808

(22) Filed: Aug. 24, 2023

(65) Prior Publication Data

US 2024/0247896 A1 Jul. 25, 2024

(30) Foreign Application Priority Data

Jan. 19, 2023 (TW) ..... 112102717

(51) Int. Cl.
*F41A 11/04* (2006.01)

(52) U.S. Cl.
CPC ..... *F41A 11/04* (2013.01)

(58) Field of Classification Search
CPC ..... F41A 11/04; F41A 21/48
USPC ..... 124/83, 84; 446/473
See application file for complete search history.

(56) References Cited

U.S. PATENT DOCUMENTS

| | | | | |
|---|---|---|---|---|
| 9,995,556 | B2 * | 6/2018 | Hall | F41C 7/11 |
| 10,704,860 | B2 * | 7/2020 | Hall | F41A 11/04 |
| 11,466,949 | B2 * | 10/2022 | Kellgren | F41A 21/30 |
| 12,196,508 | B2 * | 1/2025 | Chiappa | F41A 11/00 |
| 2018/0058802 | A1 * | 3/2018 | Hall | F41A 11/04 |
| 2019/0025012 | A1 * | 1/2019 | Hall | F41A 5/26 |
| 2019/0346231 | A1 * | 11/2019 | Ma | F41A 11/04 |

* cited by examiner

*Primary Examiner* — Joshua D Huson
(74) *Attorney, Agent, or Firm* — Leong C. Lei

(57) ABSTRACT

A folding structure of a toy gun has a main structure that includes a gun body section, a guard section pivotally mounted to one side of the gun body section, a gun barrel portion movably arranged in interiors of the gun body section and the guard section, an internal bore module arranged at an end of the gun barrel portion, an elastic element fit over the gun barrel portion, a bore latch pivotally mounted in the interior of the guard section, a bullet loading latch pivotally mounted in the interior of the gun body section and operatively collaborating with the magazine, a bore driving member arranged at a front end of the internal bore module, a driving pull handle for pushing the bore driving member, and a fixing pull handle for fixing the guard section.

9 Claims, 18 Drawing Sheets

FOLDING STRUCTURE OF TOY GUN

BACKGROUND OF THE INVENTION

(a) Technical Field of the Invention

The present invention relates generally to a folding structure of a toy gun that maximally reduces a length of the toy gun after folding and also ensures easy maintenance of an internal mechanism of a gun barrel and safety of a folded state.

(b) Description of the Prior Art

In countries having gun control regulation, the gun hobbyists can only purchase model guns to suit the needs for collecting or owning guns. Therefore, various imitation guns that do not have lethality are available and are often referred to as toy guns or BB guns in the market.

The improvements on the outside appearance of the toy gun made in materials and fabrication techniques have brought toy guns to such an effect of emulation of being relatively close to an actual gun in respect of the outside configuration, shooting operation, and shooting effect. This makes the size of the toy gun very close to that of an actual gun. For guns having a long barrel, such as a rifle and a sniper rifle, the overall size is very bulky. Further, a gun is often stowed in a storage box or a stowage case. This causes troubles for space utilization, and makes stowage of the gun barrel.

Therefore, to handle the size issue of the toy gun, the manufacturers propose folding structures, of which the most common is folding of a butt. Since the mechanical structure is simplest in the butt portion, and making folding arrangement at such a location is easy. However, the butt is at a rear half of a gun, and folding of the butt has an effect of shortening the folded length by only one quarter to one third of the overall length of the gun. The result is not ideal.

Making folding at other portion of a gun is inevitably affected by the internal mechanical structure. Except the bolt, most of the small components of the internal mechanical structure of a gun are oscillatable axially, while the large components are generally fixed and immobile. Particularly, the barrel is generally of a one-piece integrally formed structure, and there is no way for shortening of the length thereof. Although some toy guns are designed to have a detaching structure for the shroud at a middle portion of the gun barrel, yet the purpose of detaching is replacement of internal parts of the gun. Stowing under such a detached condition would make the internal parts largely and randomly dispersed, or even resulting in impossibility of reassembling.

SUMMARY OF THE INVENTION

The present invention aims to provide a folding structure of a toy gun that maximally reduces a length of the toy gun after folding and also ensures easy maintenance of an internal mechanism of a gun barrel and safety of a folded state.

The primary objective of the present invention is using an internal bore module to move a gun barrel portion frontward/rearward, and using a magazine, a bullet loading latch, and a bore latch to control the internal bore module, so that folding of a toy gun is not affected by an internal structure to maximally reduce a folded length.

An objective of the present invention is using a bore latch to ensure that a gun barrel is not foldable before a magazine is not removed to prevent a potential risk of BB bullets ejecting out of a gun body section and reliably fixing an internal bore module when folded to ensure easiness of maintaining an internal mechanism of the gun barrel.

To achieve the above objective, a main structure of the present invention comprises: a gun body section, a guard section, a gun barrel portion, an internal bore module, an elastic element, a bore latch, a bullet loading latch, at least one bore driving member, at least one driving pull handle, and a fixing pull handle, wherein the guard section is pivotally mounted to one side of the gun body section by a rotation axle portion; the gun barrel portion is movably arranged in interiors of the gun body section and the guard section; the internal bore module is arranged at an end of the gun barrel portion; the elastic element is fit over the gun barrel portion and has two ends respectively mounted to the interior of the guard section and the internal bore module; the bore latch is pivotally mounted in the interior of the guard section and correspondingly connected to the internal bore module to fix the internal bore module; the bullet loading latch is pivotally mounted in the interior of the gun body section and collaborates with a magazine to control the connection between the bore latch and the internal bore module and controls communication of the internal bore module with the magazine; the bore driving member is arranged on at least one side of a front end of the internal bore module; the driving pull handle is pivotally mounted to the guard section for pushing the bore driving member to pull the internal bore module frontward; and the fixing pull handle is pivotally mounted to the guard section to fix the guard section by means of a fixing member mounted to the gun body section.

When attempting to fold the toy gun, the user first removes the magazine to have the bullet loading latch release the internal bore module, and then pulls the driving pull handle to push the bore driving member to cause the internal bore module to drive the portion of the gun barrel portion located in the gun body section to move into the guard section, wherein at this moment, the internal bore module is naturally fixed by the bore latch, and then, pulls the fixing pull handle to release fixing of the fixing member, so as to allow the guard section to rotate about an axis defined by the rotation axle portion to one side of the gun body section to complete the folding operation. In such a folded state, the internal bore module is reliably fixed in the guard section to allow the user to easily maintain the internal mechanism of the barrel, ad further, since the internal bore module and the gun barrel portion have been moved into the guard section, the location where the rotation axle portion is set can be arranged at the central position of the entire toy gun to enhance the folding performance; and oppositely, for an attempt to expand from the folded state for subsequent use, the user only needs to reversely rotate back the guard section about the axis defined by the rotation axle portion, and applies the fixing pull handle to re-engage with the fixing member to complete fixing between the gun body section and the guard section, and as to the internal bore module and the gun barrel portion, although being temporarily fixed by the bore latch, once the user puts in the magazine, the bullet loading latch releases the bore latch, and the elastic element pushes rearward the internal bore module and the gun barrel portion to have the bullet loading latch to communicate the magazine with the internal bore module and the gun barrel portion for normal use.

Based on the above techniques, the problems that the folding structure of the toy gun of the prior art, when applied to reduce length, has only a minute effect minute effect of folding the butt, while the internal mechanism is not adjustable in respect of the position for corresponding to the folding operation and internal parts, once detached, become randomly dispersed and are not easily restored, can be overcome to achieve utilization and improvement of the present invention as noted above.

DETAILED DESCRIPTION OF THE PREFERRED EMBODIMENTS

Figure 1:
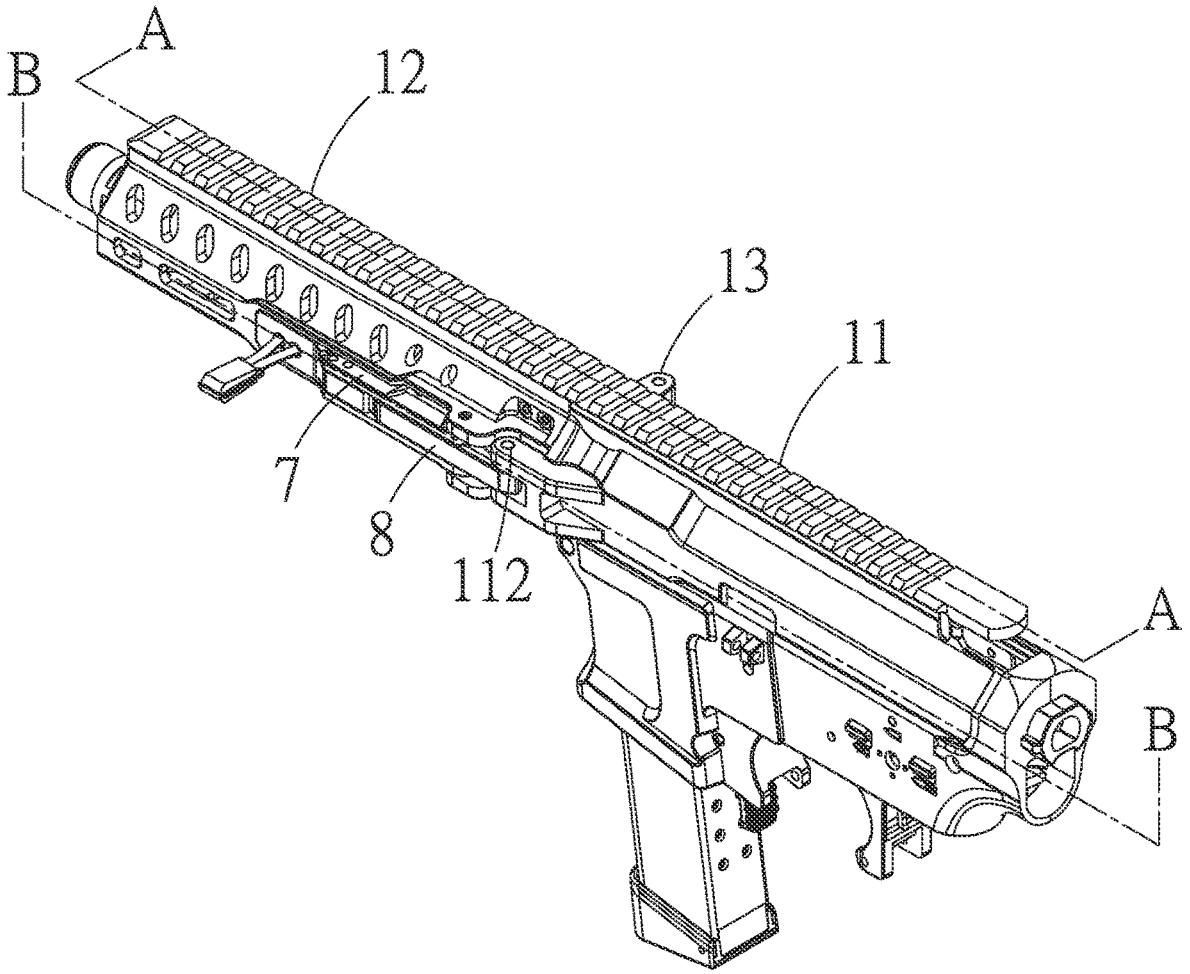
FIG. 1 is a perspective view of a preferred embodiment of the present invention.
Figure 2:
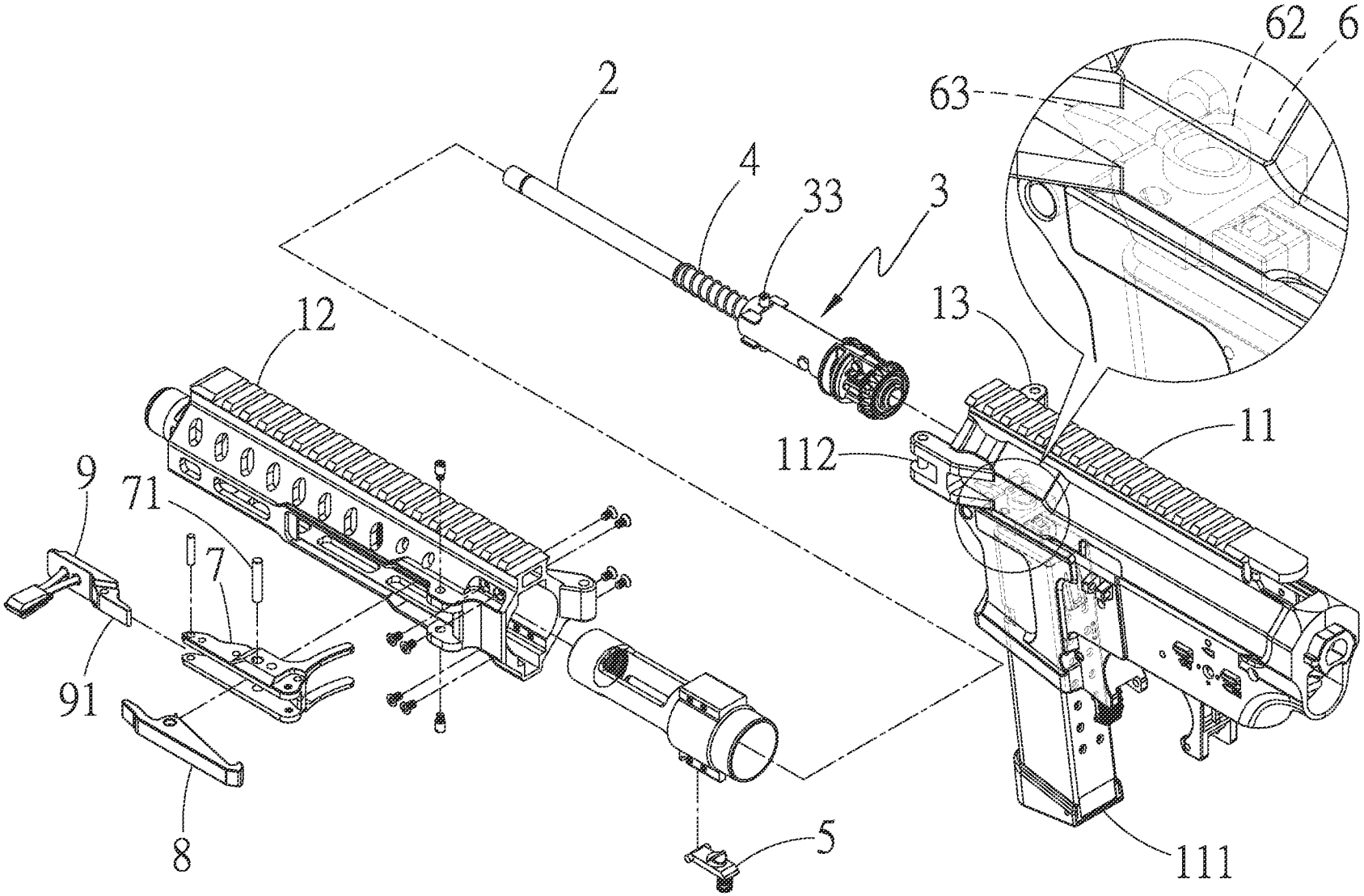
FIG. 2 is an exploded view of the preferred embodiment of the present invention.
Figure 3:
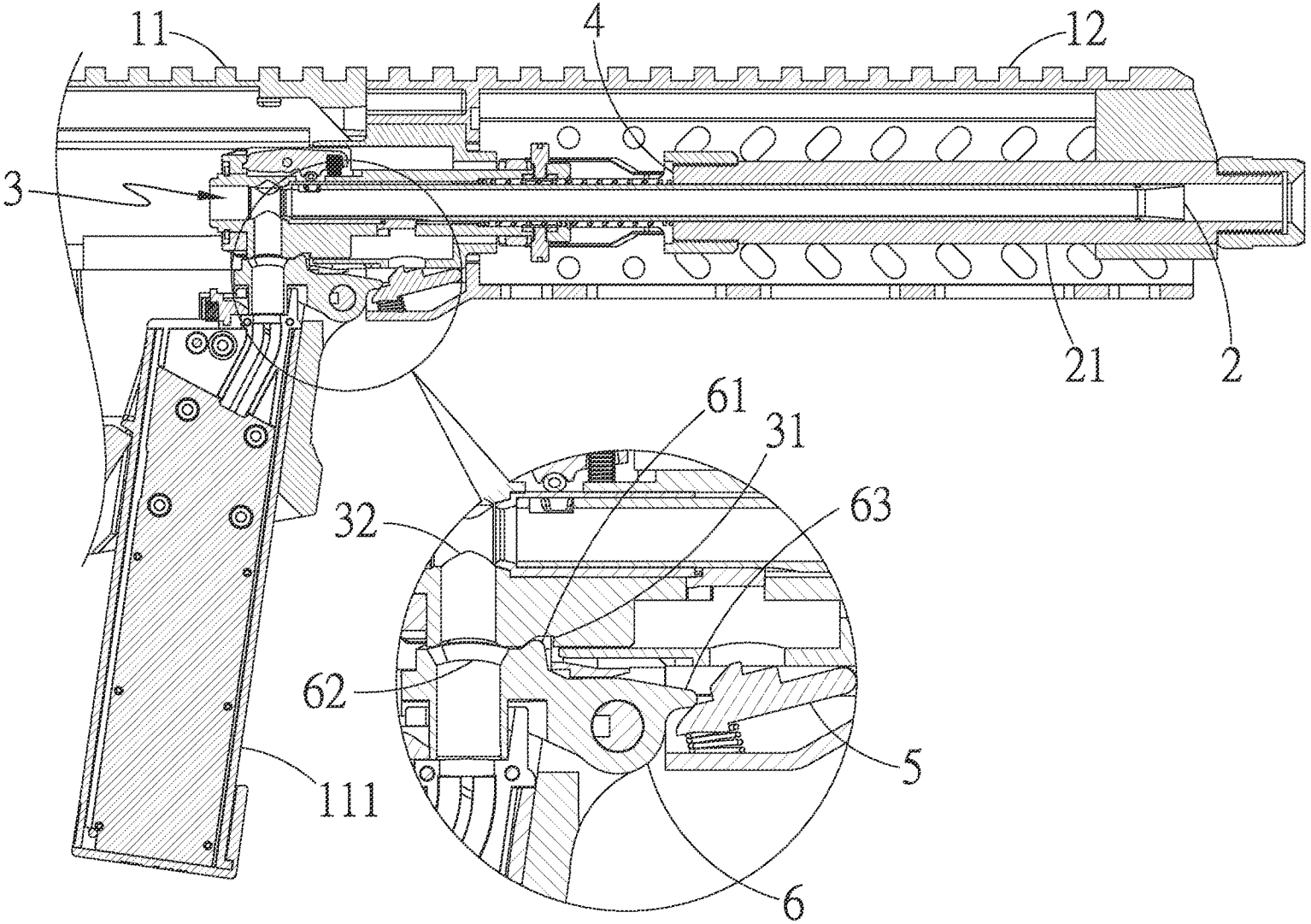
FIG. 3 is a cross-sectional view of the preferred embodiment of the present invention taken along line A-A of FIG. 1.
Figure 4:
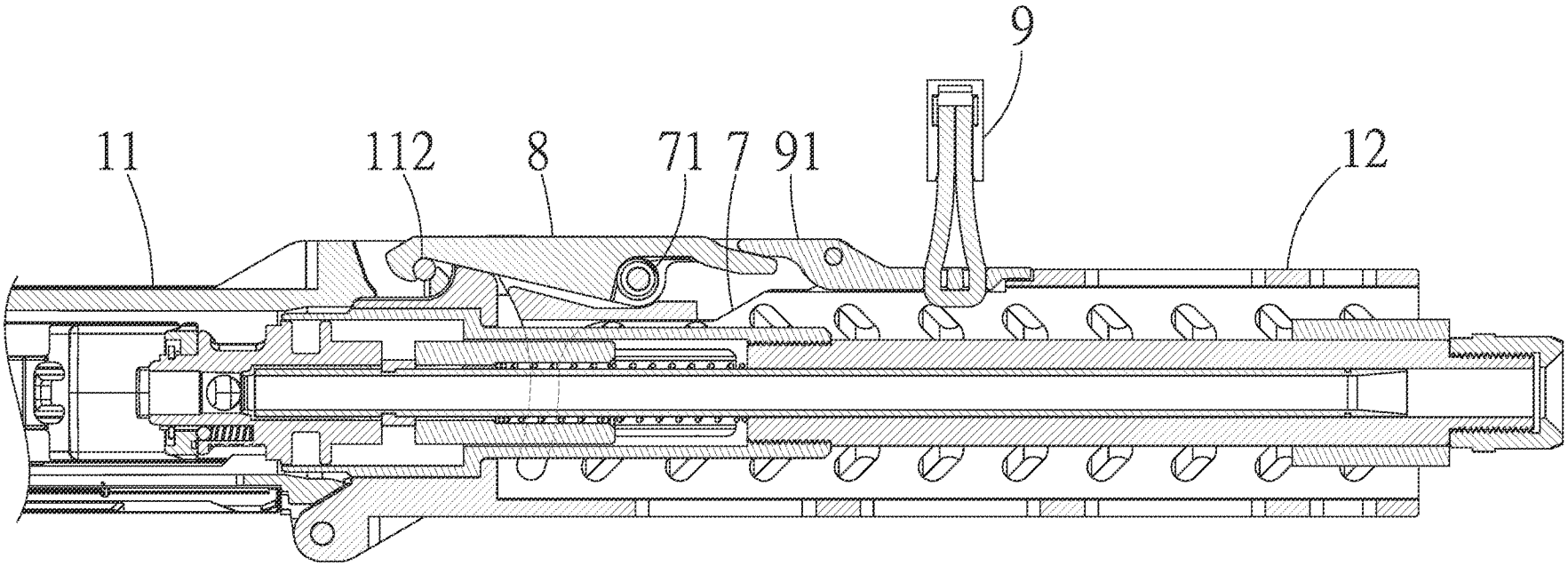
FIG. 4 is a cross-sectional view of the preferred embodiment of the present invention taken along line B-B of FIG. 1.

Referring to FIGS. 1-4, which are a perspective view of a preferred embodiment of the present invention to a cross-sectional view of the preferred embodiment of the present invention taken along line B-B of FIG. 1, it is seen clearly from the drawings that the present invention comprises:

a gun body section 11;

a guard section 12, which is pivotally mounted to one side of the gun body section 11 by a rotation axle portion 13;

a gun barrel portion 2, which is movably arranged in interiors of the gun body section 11 and the guard section 12, an external tube 21 being fixed in the interior of the guard section 12, the gun barrel portion 2 being movably arranged in an interior of the external tube 21;

an internal bore module 3, which is arranged at an end of the gun barrel portion 2, the internal bore module 3 being provided, at one side thereof, with a bore positioning portion 31, and a bore bullet-guiding portion 32 arranged at one side of the bore positioning portion 31 in communication with the gun barrel portion 2;

an elastic element 4, which is fit over the gun barrel portion 2 and has two ends respectively mounted to the external tube 21 and the internal bore module 3, a compression spring being taken as an example for illustration in the instant embodiment;

a bore latch 5, which is pivotally mounted in the interior of the guard section 12 and correspondingly connected to the bore positioning portion 31 of the internal bore module 3 to fix the internal bore module 3;

a bullet loading latch 6, which is pivotally mounted in the interior of the gun body section 11 and collaborating with a magazine 111 to control the connection between the bore latch 5 and the internal bore module 3 and control communication of the bore bullet-guiding portion 32 of the internal bore module 3 with the magazine 111, the bullet loading latch 6 being provided, at one side thereof adjacent to the internal bore module 3, with a latch positioning portion 61 to correspondingly connect to the bore positioning portion 31 of the internal bore module 3, and a latch bullet-guiding portion 62 in communication with the bore bullet-guiding portion 32 and the magazine 111, the bullet loading latch 6 being formed, at one side thereof adjacent to the bore latch 5, with a latch pressing portion 63;

at least one bore driving member 33, which is arranged on at least one side of a front end of the internal bore module 3;

at least one driving pull handle 7, which is pivotally mounted to the guard section 12 for pushing the bore driving member 33 to pull the internal bore module 3 frontward, the driving pull handle 7 including a connection axle 71; and a fixing pull handle 8, which is pivotally mounted to the connection axle 71 to fix the guard section 12 by means of a fixing member 112 mounted to the gun body section 11, a pull-handle grip 9 being pivotally mounted to one end of the driving pull handle 7 that is opposite to the fixing member 112, the pull-handle grip 9 being provided with a pull handle pressing portion 91 for pressing and holding the fixing pull handle 8.

The above description provides an understanding to the structure of the present invention, and based on a corresponding combination of such a structure, it is possible to realize the advantages of maximally reducing a folded length and also ensuring easy maintenance of the internal mechanism of the gun barrel and safety of a folded state. Further details are provided below.

Referring to FIGS. 1-12, which are a perspective view of a preferred embodiment of the present invention to a further schematic view, showing the expanding operation of the preferred embodiment of the present invention, it is seen clearly from the drawings that before folding the toy gun, a user must first remove the magazine 111 to have the bullet loading latch 6 release the internal bore module 3, otherwise due to the latch positioning portion 61 still fixing the bore positioning portion 31 in position, the internal bore module 3 and a rear portion of the gun barrel portion 2 are still fixed in the gun body section 11, and due to the gun barrel portion 2 still extending across the gun body section 11 and the guard section 12, a folding operation is not implementable. This arrangement prevents potential risks caused by BB bullets ejecting from the gun body section 11 due to folding being carried out before the magazine 111 has been removed first.

Figure 5:
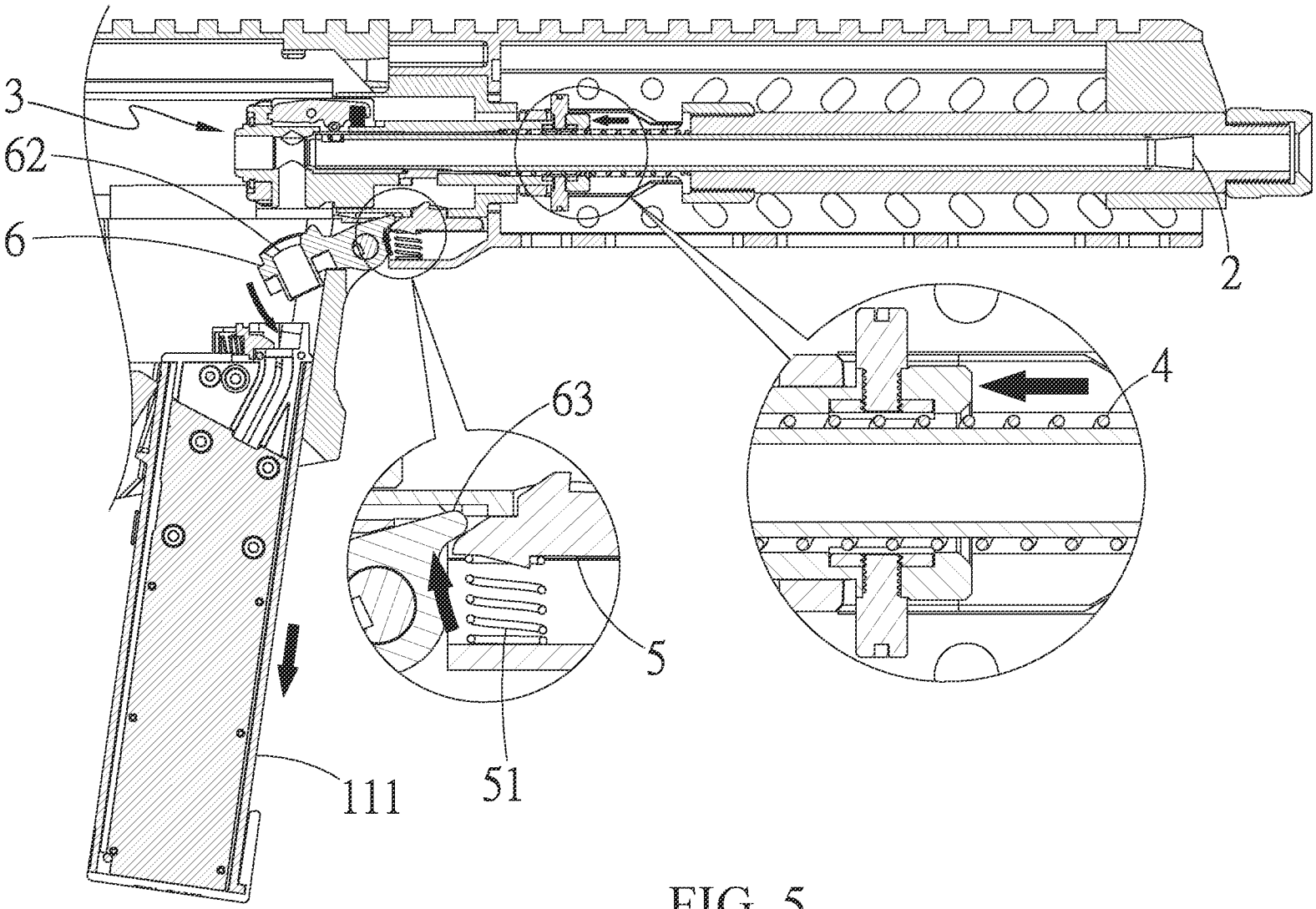
FIG. 5 is a schematic view showing a folding operation of the preferred embodiment of the present invention.
Figure 6:
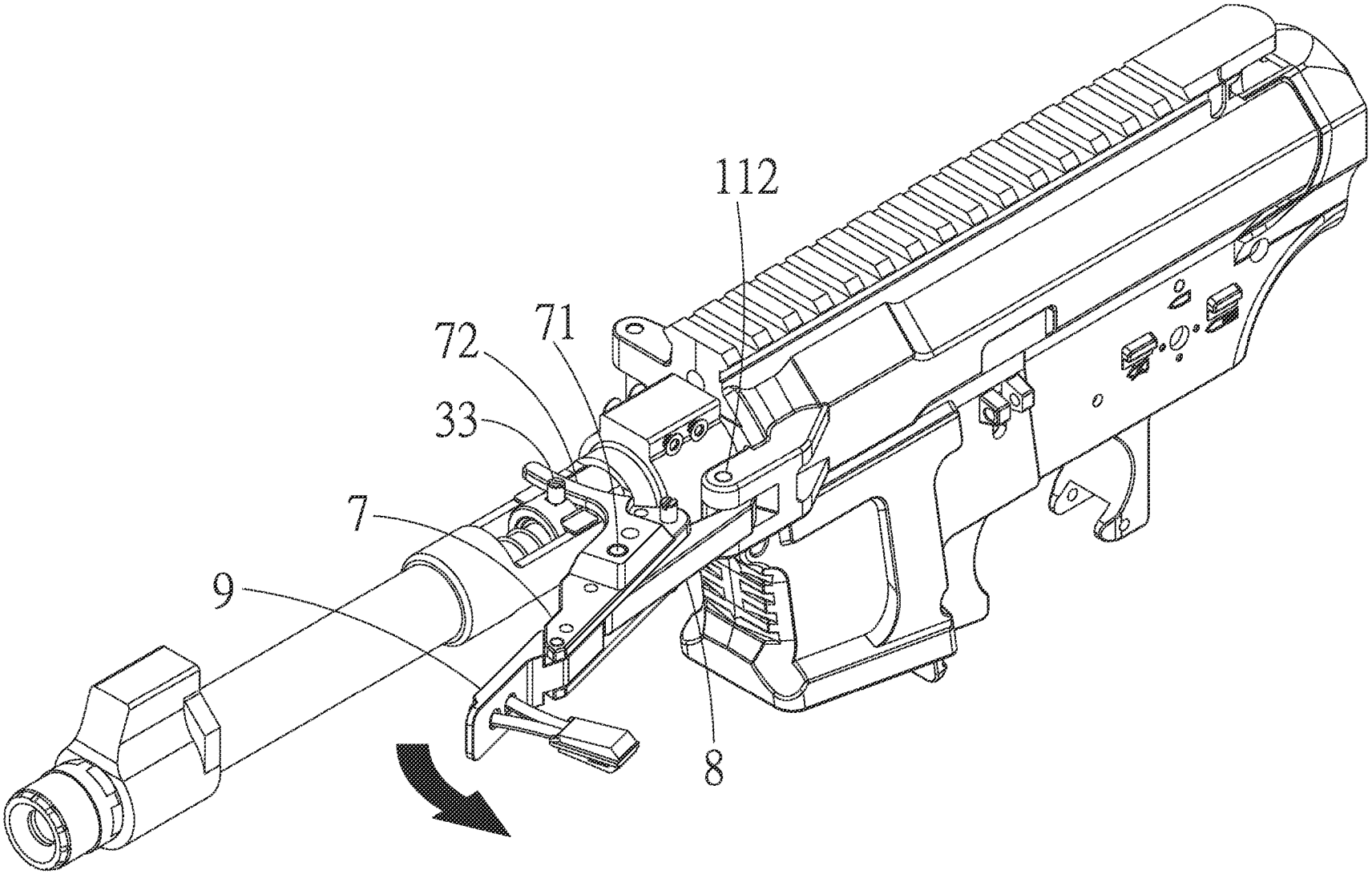
FIG. 6 is another schematic view showing the folding operation of the preferred embodiment of the present invention.
Figure 7:
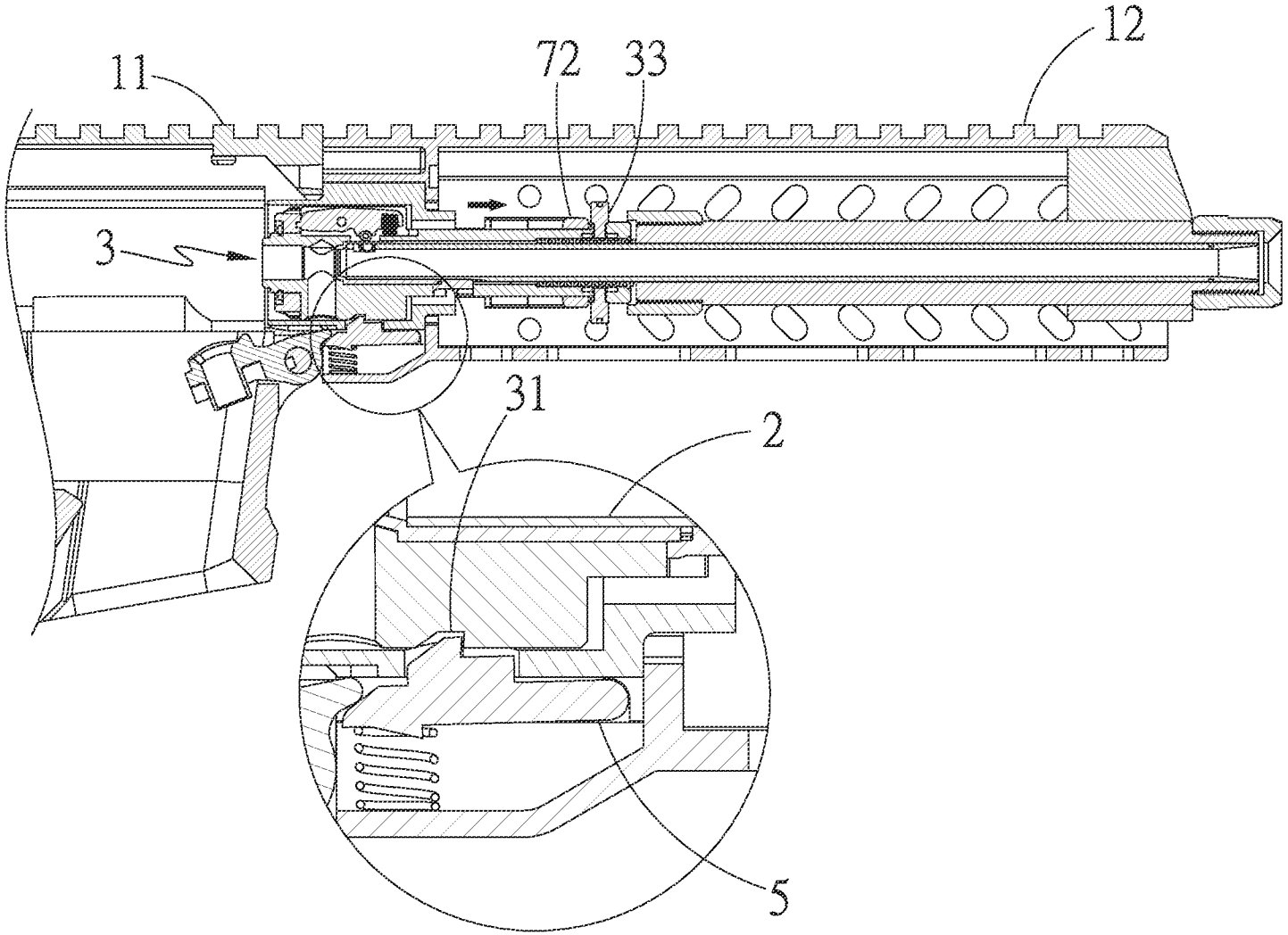
FIG. 7 is a further schematic view showing the folding operation of the preferred embodiment of the present invention.

As shown in FIG. 5, after the removal of the magazine 111, the latch bullet-guiding portion 62 of the bullet loading latch 6 is no longer positioned by the magazine 111, so that a spring force of the first elastic member 51 that pushes upwards causes the latch pressing portion 63 at the opposite end of the bullet loading latch 6 to raise upward and releasing a pressing action on the bore latch 5; however, due to the internal bore module 3 being still pushed by the spring force of the elastic element 4, the internal bore module 3 does not drive the gun barrel portion 2 to move frontward. At this time point, as shown in FIGS. 6 and 7, wherein FIG. 6 is a perspective view in which the guard section is hidden, the user needs to then pull the driving pull handle 7 to push the bore driving member 33, and in the instant embodiment, bolts that are mounted to upper and lower sidewalls of the internal bore module 3 are taken as an example of the bore driving member 33. The driving pull handle 7 is generally of a V-shape, and a tip of the V-shape is an axle center of the driving pull handle 7. The number of each of the bore driving member 33 and the driving pull handle 7 being two is provided as an example for illustration, for the purposes of ensuring a balanced force for pulling the internal bore module 3. Thus, when the driving pull handle 7 is pulled, a pull handle pushing portion 72 that is extended to the interior of the guard section 12 pushes the bore driving member 33 frontward to drive the internal bore module 3 and the gun barrel portion 2 fixed to the internal bore module 3 to move frontward to thereby have the internal bore module 3 and the gun barrel portion 2 disengaging from the gun body section 11 and entering the interior of the guard section 12.

Figure 8:
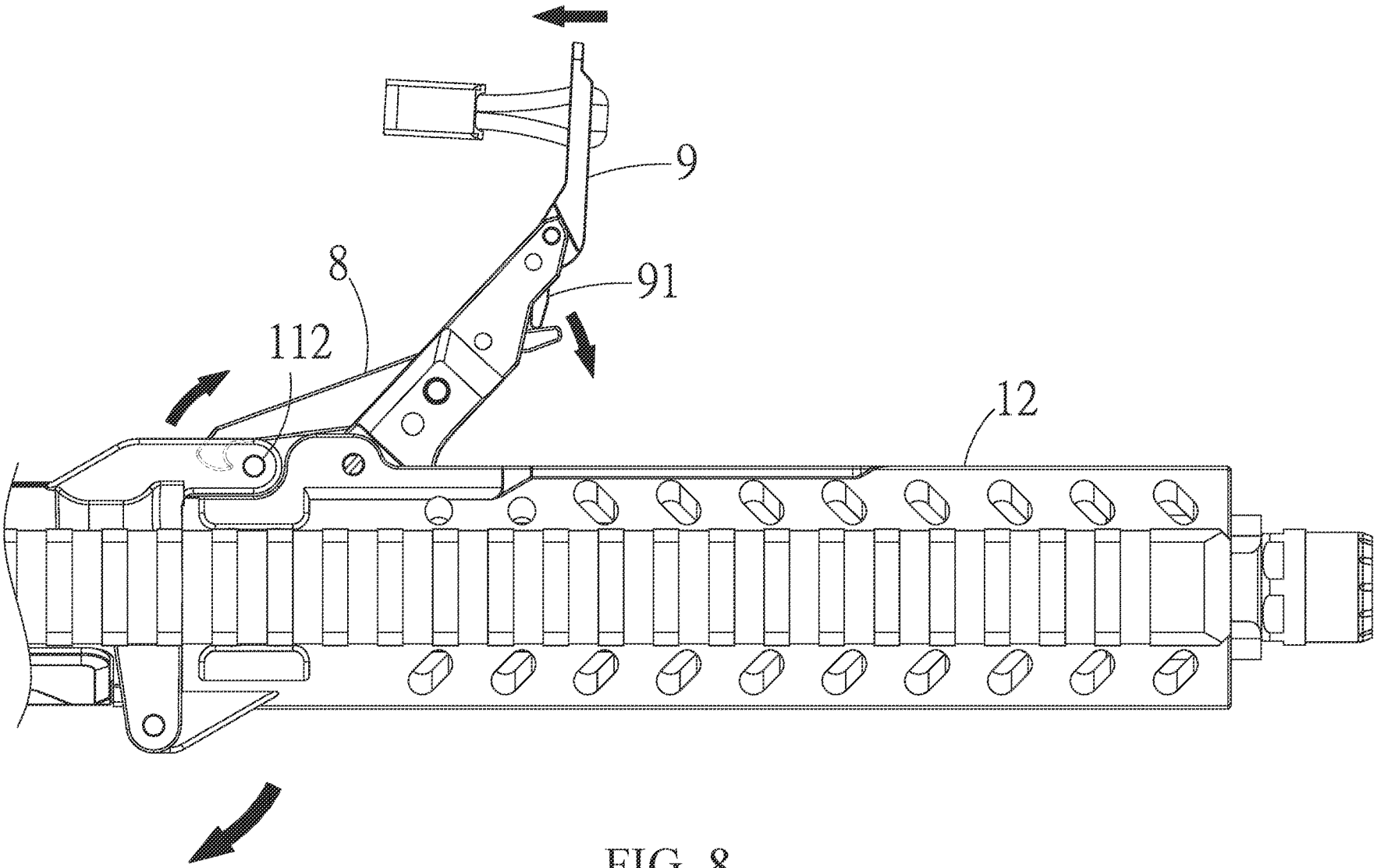
FIG. 8 is a further schematic view showing the folding operation of the preferred embodiment of the present invention.

As shown in FIGS. 6 and 8, due to the pull-handle grip 9 pivotally mounted to an end of the driving pull handle 7, for an attempt to pull the driving pull handle 7 for operation, the user may use the pull-handle grip 9 for easy application of a force. Further, due to the fixing pull handle 8 being pivotally mounted to the connection axle 71 of the driving pull handle 7, the user, when pulling the pull-handle grip 9, slightly pull the fixing pull handle 8 at the same time. However, in the instant embodiment, the fixing member 112 is made in the form of a rod, and an end of the fixing pull handle 8 that is opposite to the pull handle pressing portion 91 is made in the form of a hook, so as not to release from the fixing member 112 by such a slightly pulling motion. As such, the user has to further pull rearward the pull-handle grip 9 to have the pull handle pressing portion 91 pushing downward the fixing pull handle 8 to actually release the hook of the fixing pull handle 8 from the fixing member 112. In this way, in addition to the advantage of convenience that the user may operate the pull-handle grip 9 to simultaneously control and operate the driving pull handle 7 and the fixing pull handle 8, the two-stage operation of the pull-handle grip 9 can also help prevent the fixing pull handle 8 from being released when the user is not ready for folding the guard section 12.

Figure 9:
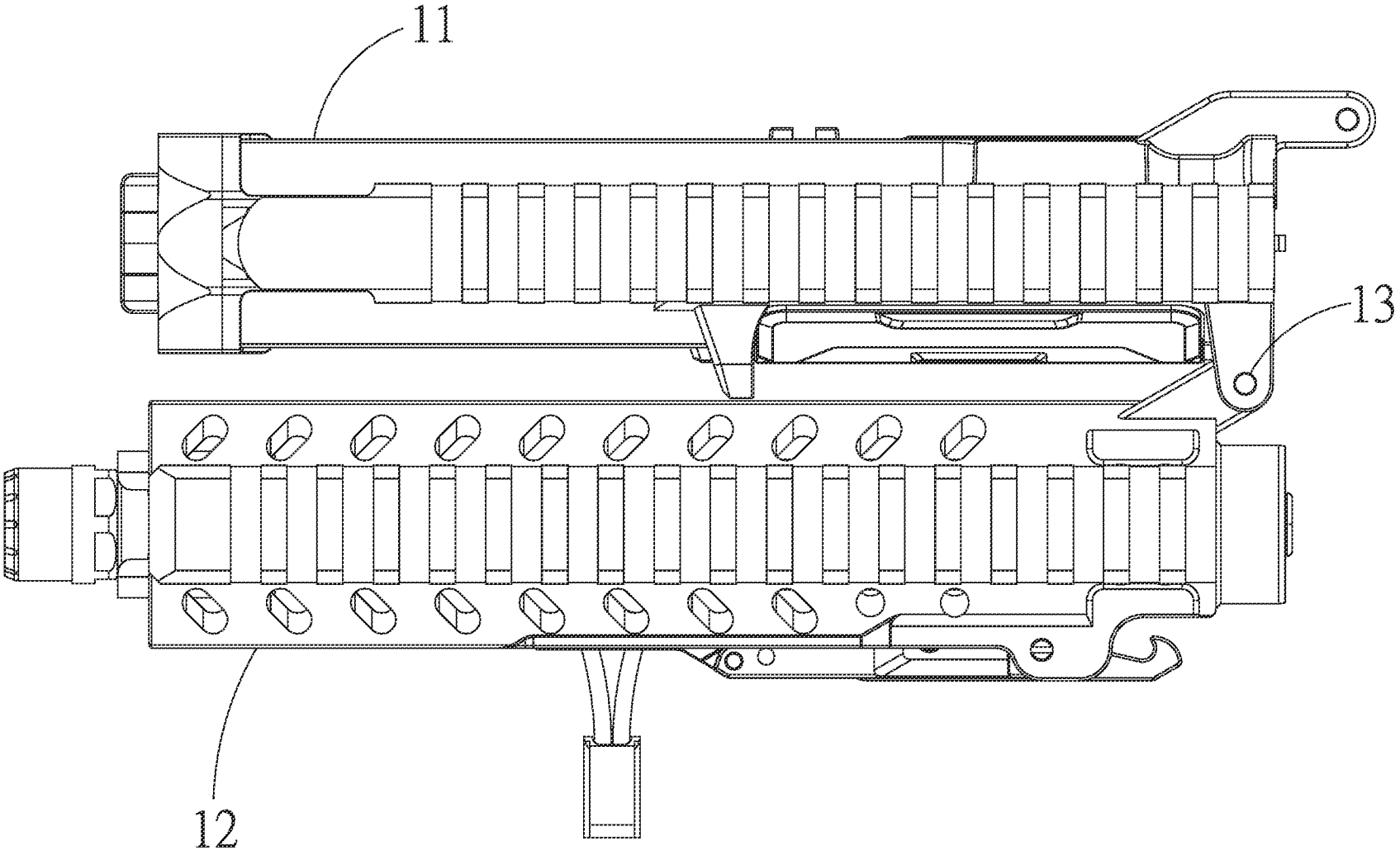
FIG. 9 is a schematic view showing a folded state of the preferred embodiment of the present invention.

Finally, as shown in FIGS. 7-9, when the internal bore module 3 has moved frontward, the bore positioning portion 31 of the internal bore module 3 is naturally fixed by the bore latch 5, and the user may rotate the guard section 12 about an axis defined by the rotation axle portion 13 to one side of the gun body section 11, and this completes the folding operation. Under such a folded state, the internal bore module 3 is reliably fixed in the interior of the guard section 12, allowing the user to maintain the barrel internal mechanism. Further, due to the internal bore module 3 and the gun barrel portion 2 being moved into the interior of the guard section 12, the location where the rotation axle portion 13 is set can be arranged at the central position of the entire toy gun to enhance the folding performance.

Figure 10:
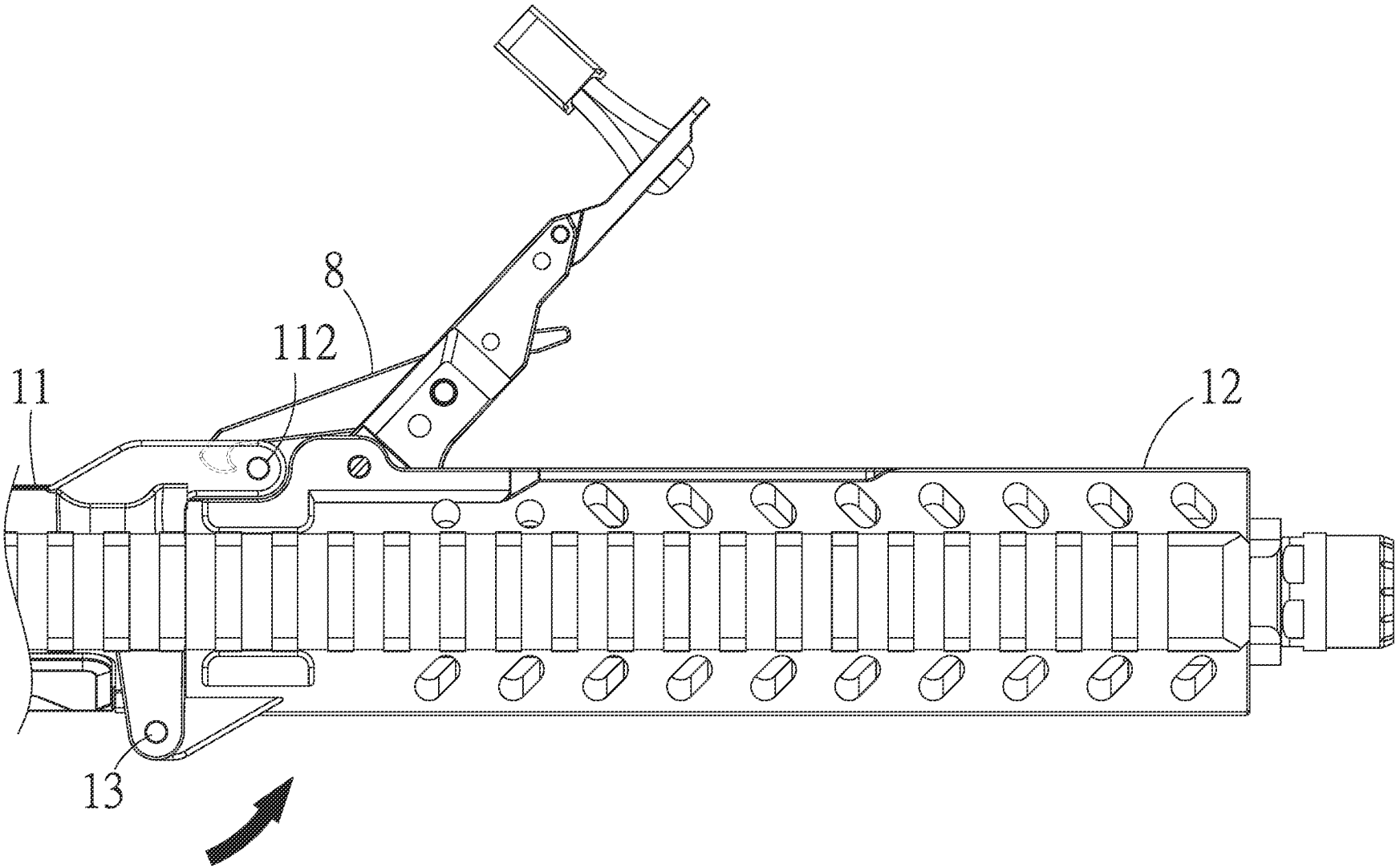
FIG. 10 is a schematic view showing an expanding operation of the preferred embodiment of the present invention.
Figure 11:
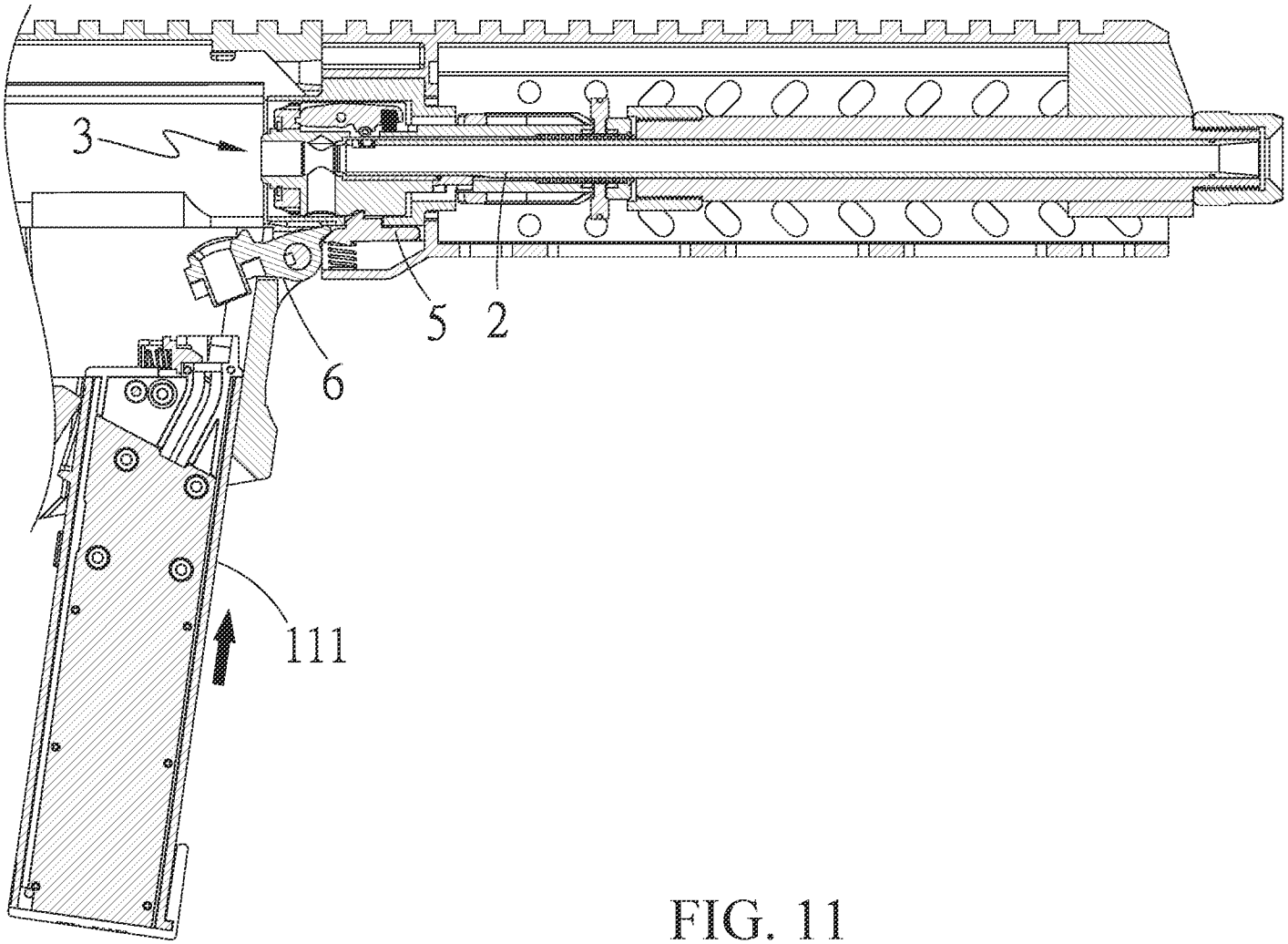
FIG. 11 is another schematic view showing the expanding operation of the preferred embodiment of the present invention.
Figure 12:
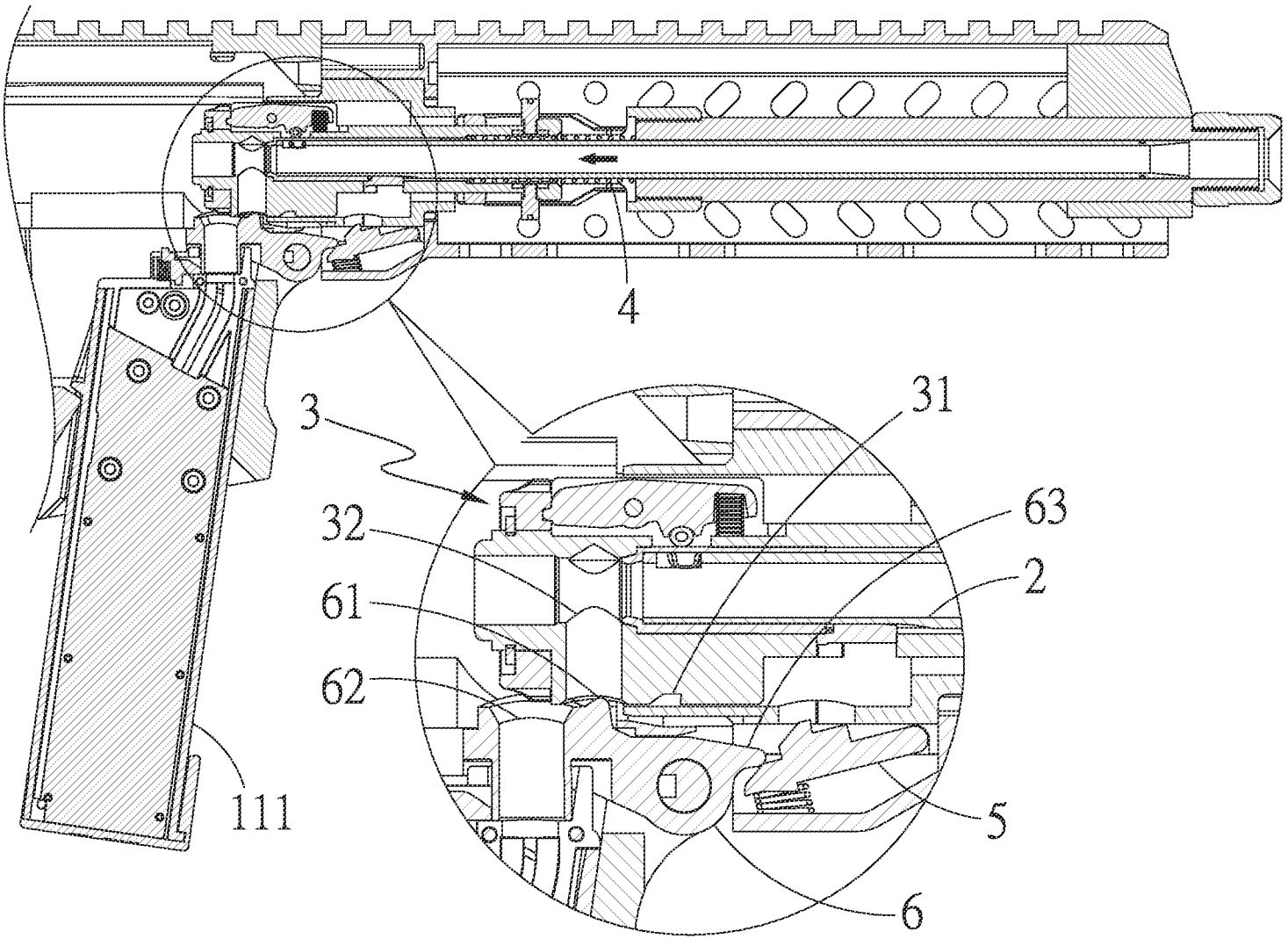
FIG. 12 is a further schematic view, showing the expanding operation of the preferred embodiment of the present invention.

As shown in FIGS. 10-12, for an attempt to expand from the folded state for subsequent use, the user only needs to reversely rotate back the guard section 12 about the axis defined by the rotation axle portion 13, and applies the fixing pull handle 8 to re-engage with the fixing member 112 to complete fixing between the gun body section 11 and the guard section 12. As to the internal bore module 3 and the gun barrel portion 2, although being temporarily fixed by the bore latch 5, once the user puts in the magazine 111, the latch pressing portion 63 of the bullet loading latch 6 presses down the bore latch 5 to release the fixing that the bore latch 5 applies to the bore positioning portion 31, and the spring force of the elastic element 4 pushes rearward and returns the internal bore module 3 and the gun barrel portion 2, so as to have the latch positioning portion 61 fixes with the bore positioning portion 31, and therefore, the latch bullet-guiding portion 62 of the bullet loading latch 6 communicates the magazine 111 with the bore bullet-guiding portion 32 of the internal bore module 3 and the gun barrel portion 2 for normal uses.

Figure 13:
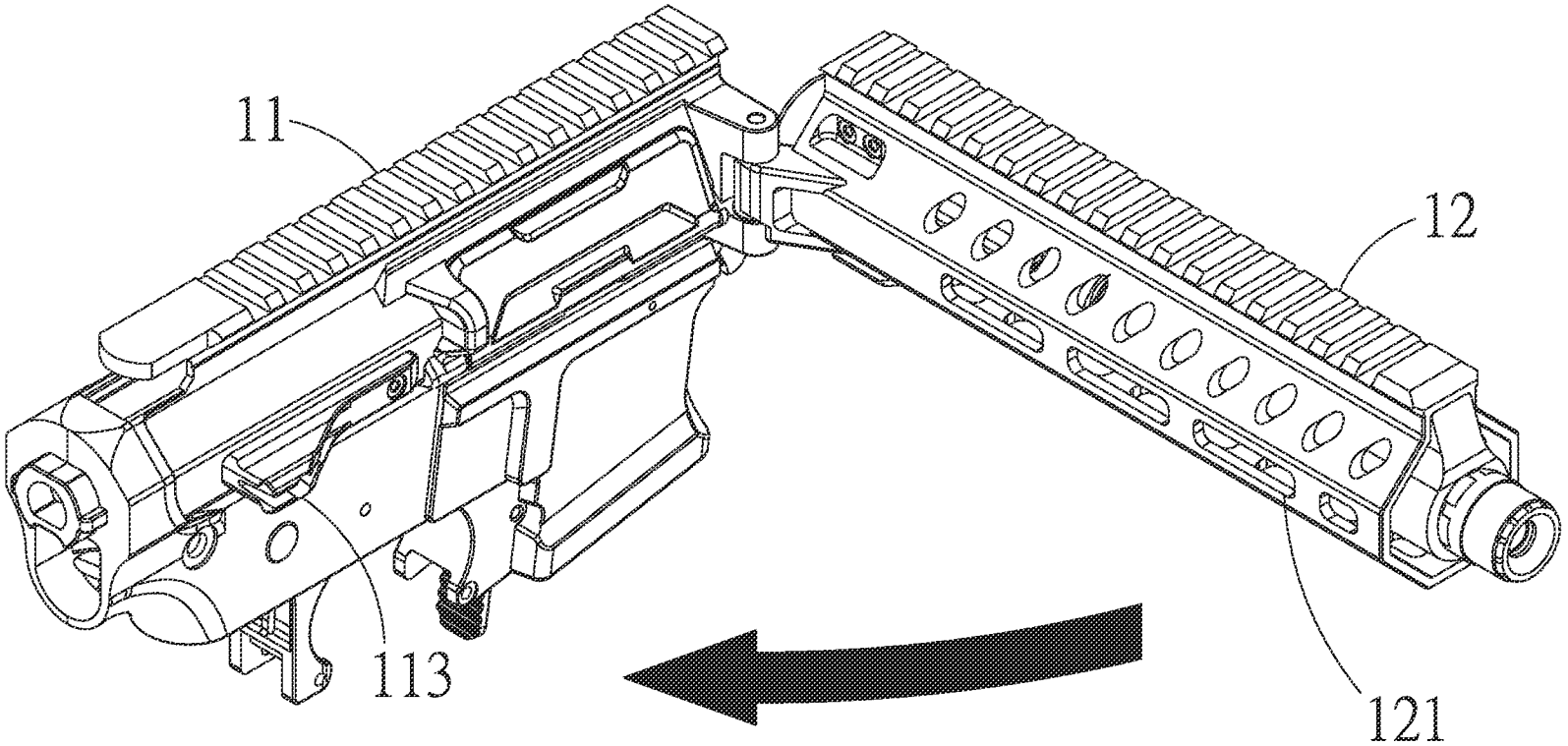
FIG. 13 is a schematic view showing folding and fixing of another preferred embodiment of the present invention.

Referring to FIG. 13, which is a schematic view showing folding and fixing of another preferred embodiment of the present invention, it is seen clearly from the drawing that in the instant embodiment, a coupling portion 113 is additionally arranged at one side of the gun body section 11. The guard section 12 is provided, at one side thereof, with at least one through-hole portion 121 to allow the coupling portion 113 to correspondingly couple with the through-hole portion 121, and the through-hole portion 121 and the coupling portion 113 are located on the same side of the guard section 12 and the gun body section 11. In the instant embodiment, the coupling portion 113 is made in the form of two spring plates is taken as an example for illustration. When the user folds the toy gun to have the gun body section 11 and the guard section 12 paralleled side by side, the coupling portion 113 on the gun body section 11 becomes aligned with the through-hole portion 121 of the guard section 12, and the coupling portion 113 is inserted into and fixed in the through-hole portion 121 by means of the elasticity thereof. This fixes the toy gun in the folded state and prevents, during the course of folding, the gun body section 11 and the guard section 12 from directly colliding with each other. Further, folding the gun body section 11 and the guard section 12 to a paralleled side by side manner allows for easy packaging or carrying.

Figure 14:
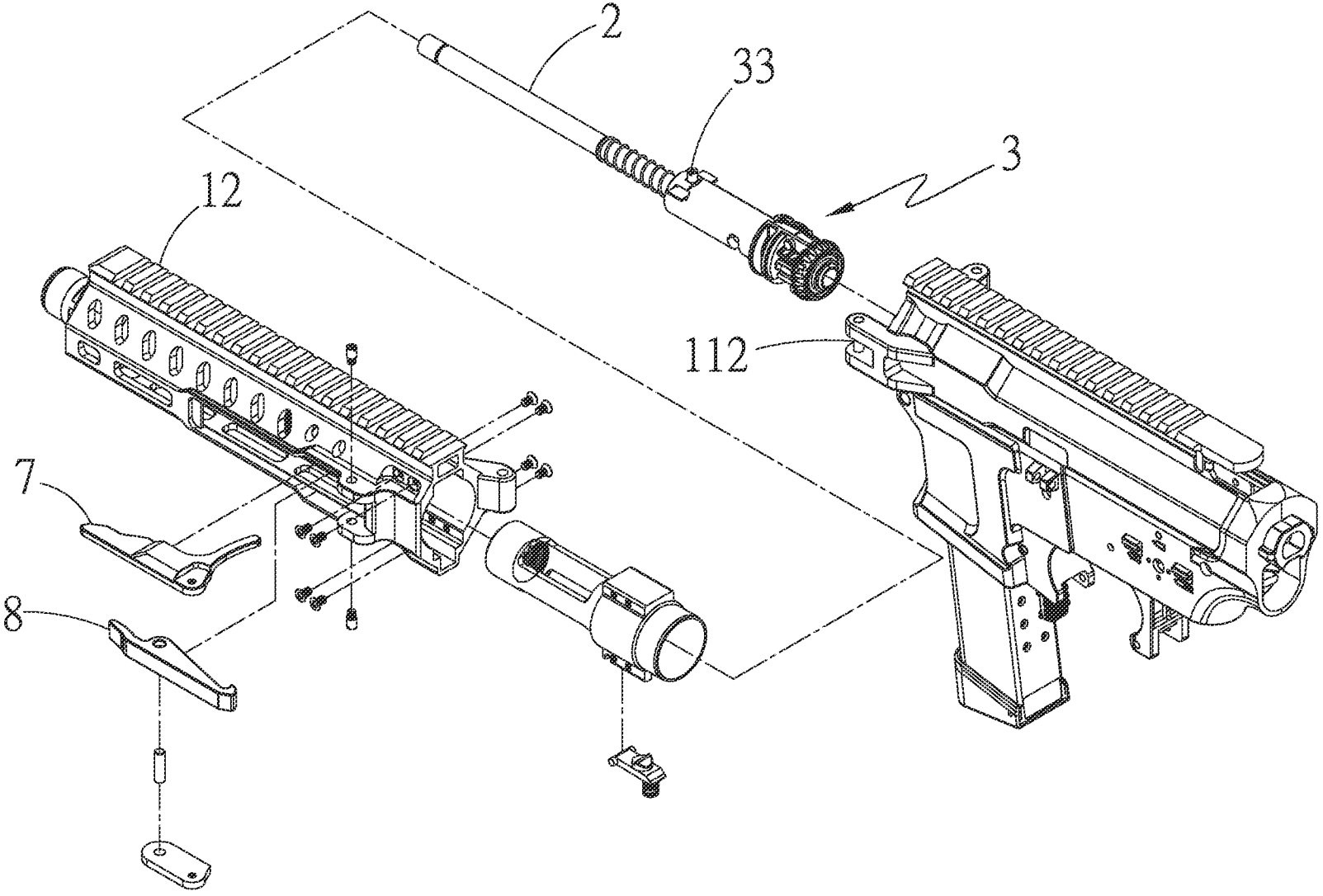
FIG. 14 is an exploded view of a further preferred embodiment of the present invention.
Figure 15:
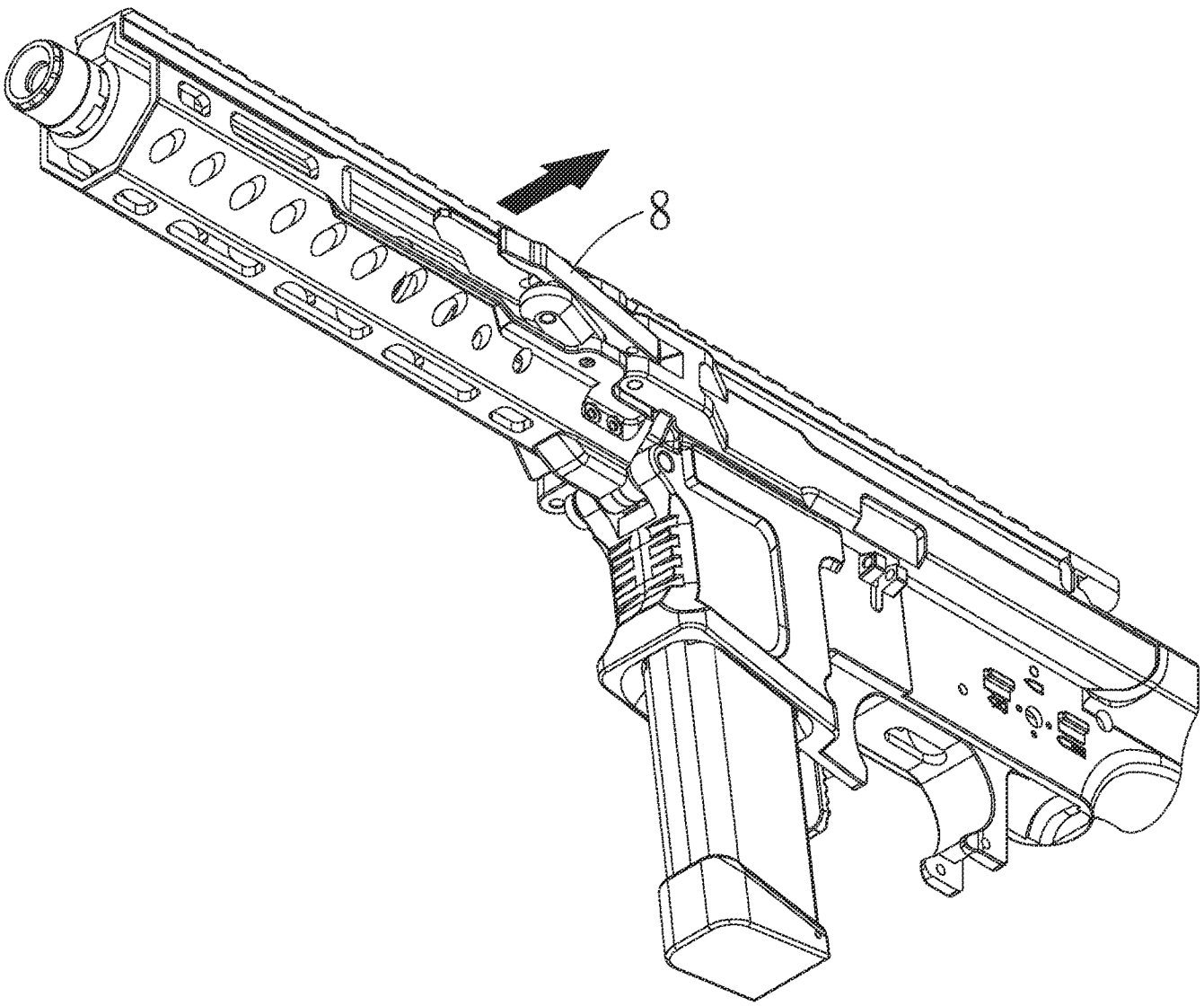
FIG. 15 is a schematic view showing operation of said further preferred embodiment of the present invention.

Referring to FIGS. 14 and 15, which are respectively an exploded view of a further preferred embodiment of the present invention and a schematic view showing operation of said further preferred embodiment of the present invention, it is seen clearly from the drawings that a major difference of the instant embodiment from the previously described embodiments is that the driving pull handle 7 and the fixing pull handle 8 are arranged to independently and pivotally mount to the guard section 12, and as such, the number of the driving pull handle 7 is just one and the number of the bore driving member 33 corresponding thereto is also one. Although the acting force applied by a single one driving pull handle 7 is shifted to one side of the gun barrel portion 2, yet, in fact, the gun barrel portion 2 being arranged internally of the external tube suffices to provide sufficient stability so that the influence is minimized. On the other hand, by setting the driving pull handle 7 and the fixing pull handle 8 independently allows the operation to be performed more intuitively by the user, minimizing the risk of erroneous operation. For example, the user does not need to consider the extent of pulling, and pulling the driving pull handle 7 alone functions to move frontward the internal bore module 3, while pulling the fixing pull handle alone releases the fixing member 112.

Figure 16:
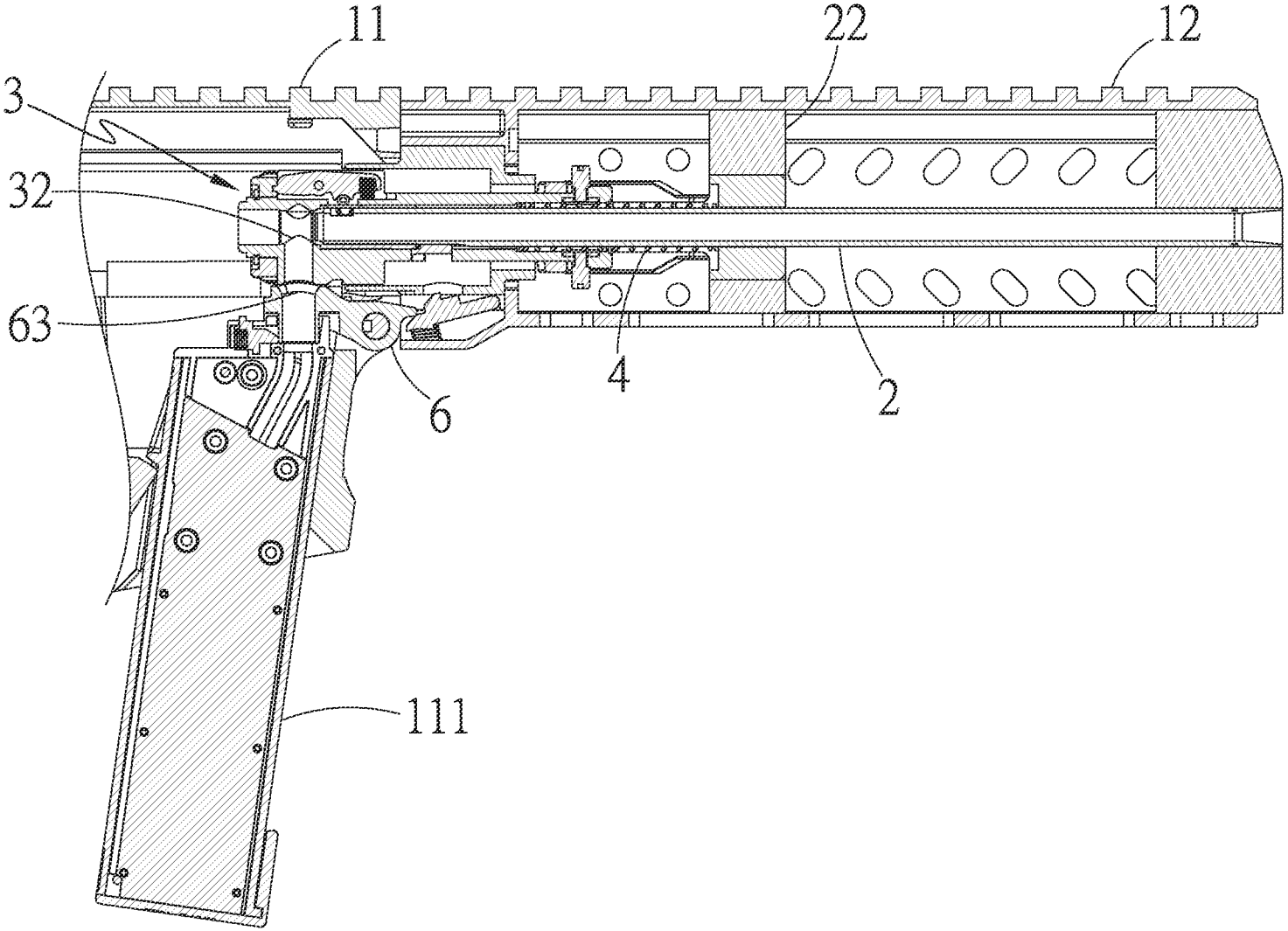
FIG. 16 is a schematic view showing a structure of a further preferred embodiment of the present invention.

Referring to FIG. 16, which is a schematic view showing a structure of a further preferred embodiment of the present invention, it is seen clearly from the drawing that a major difference of the instant embodiment from the previously described embodiments is that the arrangement of the external tube is omitted and is replaced by a support structure 22 arranged inside the guard section 12 to similarly achieve the purpose of stabilizing the gun barrel portion 2 and the arrangement of the latch positioning portion of the bullet loading latch 6 is omitted to simplify the structure of the bullet loading latch 6, while the internal bore module 3 is fixed in position in the interior of the gun body section 11 by means of increasing of the spring force of the elastic element 4 to similarly achieve the purposes of communicating among the magazine 111, the latch bullet-guiding portion 62, the bore bullet-guiding portion 32, and the gun barrel portion 2. This is provided to illustrate the design flexibility of the structure of the present invention.

Figure 17:
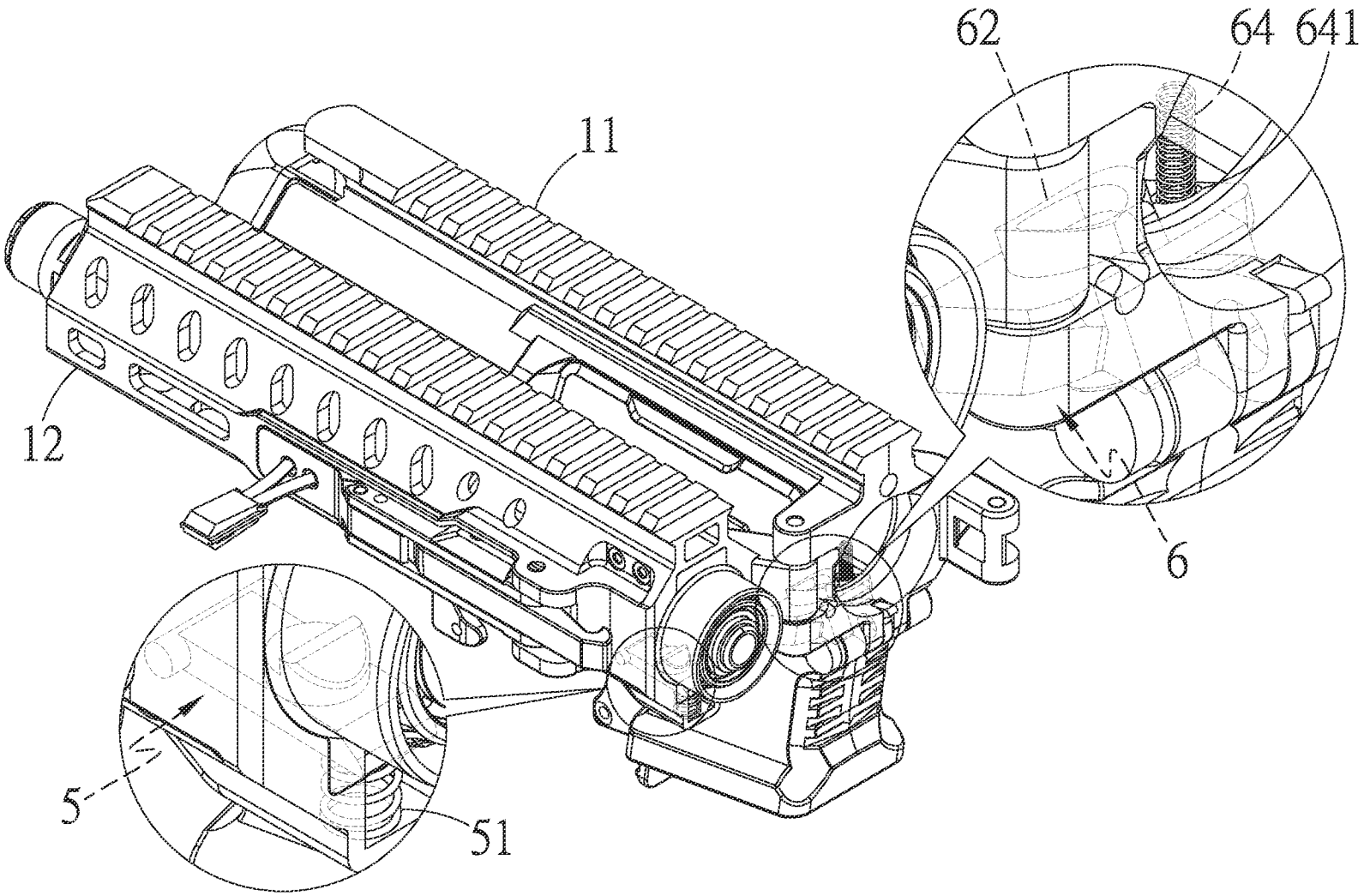
FIG. 17 is a schematic view showing operation of a further preferred embodiment of the present invention.
Figure 18:
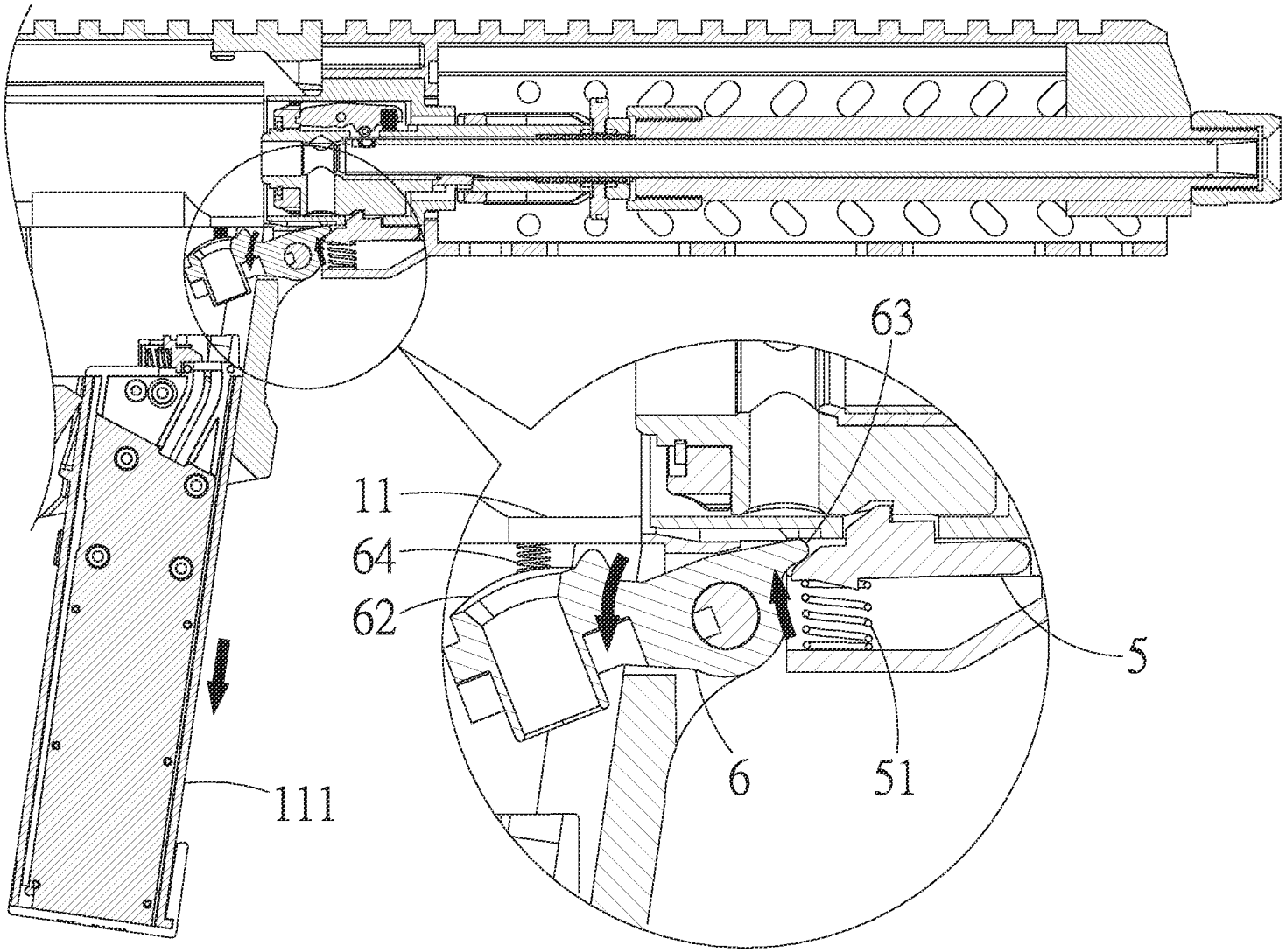
FIG. 18 is a schematic view showing implementation of said further preferred embodiment of the present invention.

Referring to FIGS. 17 and 18, which are respectively a schematic view showing operation of a further preferred embodiment of the present invention and a schematic view showing implementation of said further preferred embodiment of the present invention, it is seen clearly from the drawings that in the instant embodiment, a second elastic member 64 mounted to the gun body section 11 is arranged at one side of the bullet loading latch 6 that is adjacent to the latch bullet-guiding portion 62, and the second elastic member 64 is a compression spring having one end fixed to the gun body section 11 and an opposite end disposed in a retaining groove 641 on a surface of the bullet loading latch 6 to apply a spring force to push, from top to bottom, one side of the bullet loading latch 6 that is opposite to the latch pressing portion 63, while the first elastic member 51 pushes, from bottom to top, an underside of the bore latch 5, so that the first elastic member 51 and the second elastic member 64 respectively act on an upper side and a lower side of the bullet loading latch 6 corresponding to two ends of the axis. Thus, based on lever rule, the second elastic element 64 provides an effect of assisting the first elastic element 51 to ensure that the bullet loading latch 6 may release the pressing operation applied to the bore latch 5 after the removal of the magazine 111.

Further, when the toy gun is in the folded state, the bore latch 5 and the bullet loading latch 6 are respectively located in the guard section 12 and the gun body section 11, so that the bullet loading latch 6 is not positioned with respect to the magazine 111, and after being pushed by the bore latch 5, becomes a state of free oscillation, resulting in easy occurrence of undesired collision and wear of the bullet loading latch 6 and also leading to noise generated by shaking of the gun. For this, a second function of the second elastic member 64 is to push the bullet loading latch 6 in the state of free oscillation of the bullet loading latch 6, to fix and immobilize it in order to overcome the above problem.

I claim:

1. A folding structure of a toy gun, mainly comprising:

a gun body section;

a guard section, which is pivotally mounted to one side of the gun body section by a rotation axle portion;

a gun barrel portion, which is movably arranged in interiors of the gun body section and the guard section;

an internal bore module, which is arranged at an end of the gun barrel portion;

an elastic element, which is fit over the gun barrel portion and has two ends respectively mounted to the interior of the guard section and the internal bore module;

a bore latch, which is pivotally mounted in the interior of the guard section and correspondingly connected to the internal bore module to fix the internal bore module;

a bullet loading latch, which is pivotally mounted in the interior of the gun body section and collaborates with a magazine to control the connection between the bore latch and the internal bore module and controls communication of the internal bore module with the magazine;

at least one bore driving member, which is arranged on at least one side of a front end of the internal bore module;

at least one driving pull handle, which is pivotally mounted to the guard section for pushing the bore driving member to pull the internal bore module frontward; and a fixing pull handle, which is pivotally mounted to the guard section to fix the guard section by means of a fixing member mounted to the gun body section.

2. The folding structure of the toy gun according to claim 1, wherein the bullet loading latch is provided, at one side thereof that is adjacent to the internal bore module, with a latch positioning portion to correspondingly connect to the internal bore module.

3. The folding structure of the toy gun according to claim 1, wherein an external tube is fixed in the interior of the guard section, and the gun barrel portion is movably arranged in the interior of the external tube, and one end of the elastic element that is opposite to the internal bore module is mounted on the external tube.

4. The folding structure of the toy gun according to claim 1, wherein the driving pull handle includes a connection axle for pivotally mounting the fixing pull handle.

5. The folding structure of the toy gun according to claim 4, wherein a pull-handle grip is pivotally mounted to one end of the driving pull handle that is opposite to the fixing member, and the pull-handle grip is provided with a pull handle pressing portion for pressing and holding the fixing pull handle.

6. The folding structure of the toy gun according to claim 1, wherein the guard section is provided, at one side thereof, at least one through-hole portion, and the gun body section is provided, at one side thereof, with a coupling portion that is correspondingly connectable with the through-hole portion, and the through-hole portion and the coupling portion are located on a same side of the guard section and the gun body section.

7. The folding structure of the toy gun according to claim 1, wherein the internal bore module is provided, at one side thereof, with a bore positioning portion, and a bore bullet-guiding portion arranged at one side of the bore positioning portion in communication with the gun barrel portion.

8. The folding structure of the toy gun according to claim 7, wherein the bullet loading latch is formed, at one side thereof adjacent to the bore latch, with a latch pressing portion, and the bullet loading latch is provided, at one side thereof adjacent to the internal bore module, with a latch bullet-guiding portion in communication with the bore bullet-guiding portion and the magazine.

9. The folding structure of the toy gun according to claim 8, wherein a second elastic member that is mounted to the gun body section is arranged at one side of the bullet loading latch that is adjacent to the latch bullet-guiding portion.

* * * * *